United States Patent [19]

Batio et al.

[11] Patent Number: 5,010,711

[45] Date of Patent: Apr. 30, 1991

[54] FOUNDATION LEVELING AND EQUALIZATION SYSTEM

[76] Inventors: Gilford P. Batio; Jeffrey A. Batio, both of 534 N. Grace St., Mundelein, Ill. 60060

[21] Appl. No.: 463,903

[22] Filed: Jan. 10, 1990

Related U.S. Application Data

[63] Continuation of Ser. No. 187,385, Apr. 28, 1988, abandoned.

[51] Int. Cl.[5] ..... E04B 1/00

[52] U.S. Cl. ..... 52/742; 52/743; 52/169.1

[58] Field of Search ..... 52/742, 743, 127.3, 52/127.4, 300, 293, 295, 169.1, 309.17; 264/34, 35

[56] References Cited

U.S. PATENT DOCUMENTS

| | | | |
|---|---|---|---|
| 2,873,505 | 2/1959 | Sheldon | 264/34 |
| 3,579,617 | 5/1971 | Smith | 264/35 |
| 3,685,241 | 8/1972 | Cooper | 52/300 |
| 3,748,810 | 7/1973 | Mattingly | 52/742 |
| 4,048,270 | 9/1977 | Stegmeier | 264/35 |
| 4,076,474 | 2/1978 | Catenacci | 425/64 |
| 4,169,909 | 10/1979 | Milme | 52/743 |
| 4,229,153 | 10/1980 | Hight | 425/64 |
| 4,392,335 | 7/1983 | Heiman | 52/309.17 |
| 4,574,554 | 3/1986 | Gentry | 52/105 |
| 4,799,348 | 1/1989 | Brami | 52/169.1 |

*Primary Examiner*—Henry E. Raduazo

*Attorney, Agent, or Firm*—Neuman, Williams, Anderson & Olson

[57] ABSTRACT

A method of applying a layer of filler material to an existing concrete foundation to provide a substantially level foundation surface, includes the steps of determining the amount of deviation of the top surface of a foundation wall from a level surface and the amount of filler material sufficient to minimally exceed the volume formed by the deviation along the foundation wall. The method includes positioning a filler material retaining form along the top surface of the foundation wall and securing the retaining form to the foundation. The form consists of a sheet of resilient material having a perforation in the top surface thereof. The determined amount of filler material is poured into the form through the perforation and then allowed to harden.

In this manner a substantially level foundation system is provided which comprises a layer of hardened epoxy-resin material along the top surface of an existing foundation wall. The layer of hardened epoxy-resin material forms a level surface for the foundation wall.

9 Claims, 1 Drawing Sheet

FOUNDATION LEVELING AND EQUALIZATION SYSTEM

This application is a continuation of application Ser. No. 07/187,385, filed Apr. 28, 1988.

BACKGROUND OF THE INVENTION

1. Field of the Invention

The present invention relates to systems for leveling foundation walls and, more particularly, to a method of providing a substantially level surface for an existing foundation wall which involves forming a layer of filler material on the top surface of the existing wall. The filler material is utilized to provide a substantially level surface for subsequent construction work.

2. Description of the Prior Art

The top surfaces of formed concrete foundations are inherently unlevel. This is a result of a number of factors. The most common factor involves inconsistent quantities of water dispersed throughout the batches of concrete delivered to the foundation site by the concrete ready-mix company. Once at the foundation construction site, the concrete crew at the site will also typically add water to the ready-mix concrete load in order to ease movement of the concrete into place in the foundation forms.

Since the water in the concrete displaces, in part, the mass of concrete at its particular location, areas of concrete with greater quantities of water will settle further than areas with lesser quantities of water as the concrete dries. This uneven settling of the concrete during drying results in an unlevel top surface of the foundation wall.

To correct the variances in the height of the foundation, the typical practice of the carpentry crew preparing a floor or deck on the top of the foundation is to level the deck or floor, and not attempt to level the foundation surface. Leveling of the floor is accomplished by shooting the elevation or grade. Shooting the grade involves surveying the foundation with a transit; finding the high and low spots of the deck or floor; and then adding wood or metal shims at the low spots to raise the deck or floor to a level position. This procedure must be followed with grouting of the foundation with a cement mortar mixture in order to prevent further settling of the foundation.

The manpower and time necessary for shooting the grade and adding shims is normally on the order of two men working for four to eight hours. Following the leveling of the floor, additional manpower and time is necessarily expended in grouting the foundation around the floor. Time for grouting the foundation varies depending on the size of the structure, but generally involves eight to twelve hours.

As a result of the manpower time and expense, and material expense involved in using the existing methods of leveling a foundation, there is a need in the construction field for a method of providing a substantially level foundation system which minimizes the expense of manpower and materials. Such a method should provide a level surface through the use of inexpensive and disposable materials. Such a system should provide a stable surface which is able to accommodate the pressure and weight of the complete structure, i.e., a house or building, and also provide a level platform upon which to build. The system should also preferably aid insulation and not absorb moisture.

The foundation leveling system of the present invention satisfies these needs by providing a simple and inexpensive method for achieving a level foundation system.

OBJECTS OF THE INVENTION

It is an object of this invention to provide a foundation leveling system, and particularly to provide a system which meets the aforenoted needs.

It is a specific object of this invention to provide a method of applying and securing a layer of filler material to an existing concrete foundation to provide a level foundation surface.

It is further object of this invention to provide a level foundation surface system that avoids the disadvantages and complexities of the prior art.

It is a another object of this invention to provide a level foundation surface system which meets the aforestated objects and which minimizes the expense of manufacture.

It is another object of this invention to provide a method of applying a layer of filler material to an existing concrete foundation which is simple and inexpensive and provides a substantially level foundation surface.

Other objects, advantages and features of the present invention will become apparent upon reading the following detailed description and appended claims, and upon reference to the accompanying drawings.

SUMMARY OF THE INVENTION

In accordance with one method of this invention, a method of applying a layer of filler material to an existing concrete foundation to provide a substantially level foundation surface includes the steps of determining the amount of deviation of the top surface of a foundation wall from a level surface and the amount of filler material sufficient to minimally exceed the volume formed by the deviation along the foundation wall. The method includes positioning a filler material retaining form along the top surface of the foundation wall and securing the filler material retaining form to the foundation. The form consists of a sheet of substantially resilient material having at least one opening along its top surface. The determined amount of filler material is poured into the form through the opening and then allowed to harden.

In this manner a substantially level foundation system is provided which comprises a layer of hardened epoxy-resin material along the top surface of an existing foundation wall. The layer of hardened epoxy-resin material forms a level surface for the foundation wall.

BRIEF DESCRIPTION OF THE DRAWINGS

For a more complete understanding of this invention, one should refer to the preferred embodiments illustrated in greater detail in the accompanying drawings and described below by way of examples of the invention. In the drawings.

DETAILED DESCRIPTION OF THE DRAWINGS

Figure 1:
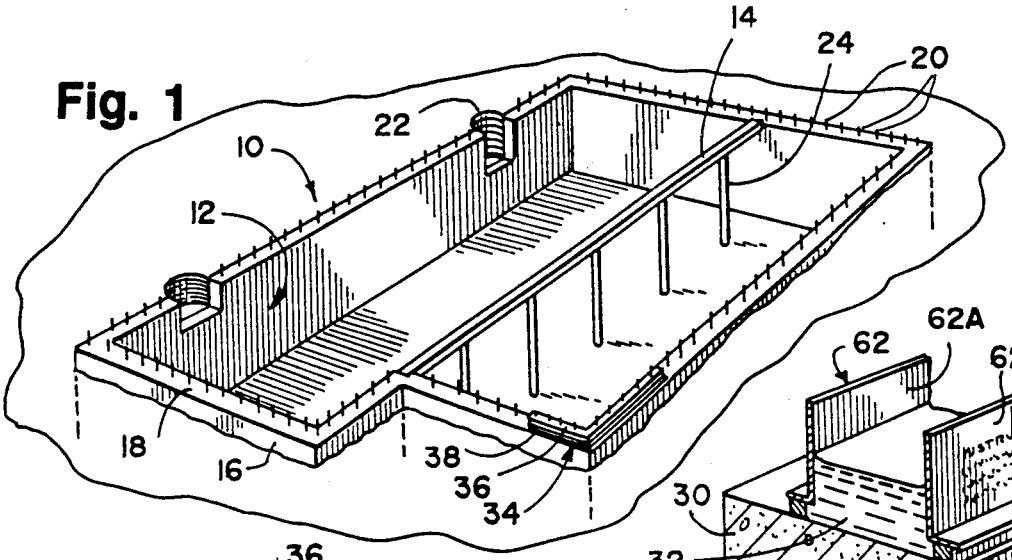
FIG. 1 is a perspective view of a concrete foundation illustrating the location of a portion of the retaining form of this invention along the foundation.

Turning now to the drawings, FIG. 1 shows a concrete foundation 10, typical of the type utilized with the present invention, with a foundation wall 12 and internal structural beam or cross-beam 14. The wall 12 includes a side surface 16 and a top surface 18. Imbedded in the top surface 18 are a series of bolts 20, extending out of the top surface 18. The foundation 10 includes wells 22 and cross-beams 14 with cross-beam supports 24.

Figure 3:
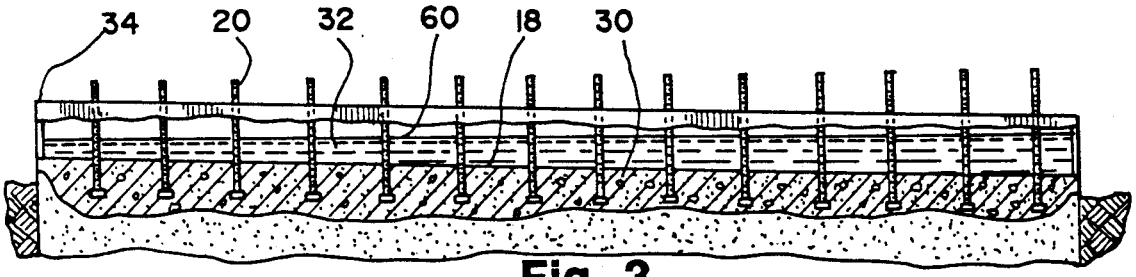
FIG. 3 is side section view of the concrete foundation with a level top surface of filler material and a section view of the retaining form thereon.

The concrete foundation 10 is typically unlevel as a result of a variety of factors, including differing quantities of water dispersed within various portions of the concrete as it is poured to form the foundation. As the concrete hardens and settles, with the water being absorbed or evaporated, the foundation settles unevenly. The resulting unlevel foundation is shown more clearly in the sectional view of FIG. 3. The top surface 18 of concrete 30 is unlevel in both the longitudinal and lateral directions, i.e., the directions running along the length and width of the foundation. FIG. 3 shows the unlevel nature of the surface only along the length of the foundation.

Figure 2:
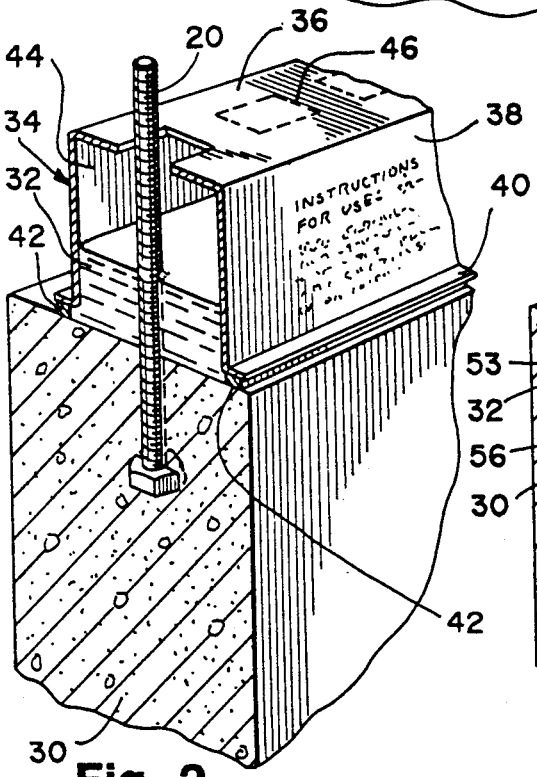
FIG. 2 is a perspective section view of the concrete foundation of FIG. 1 and illustrating a section view of the location of the retaining form of this invention with filler material therein.

The leveling of foundation 10 is accomplished in accordance with the present invention by using a layer of filler material 32 on the top surface 18 of the concrete foundation. As shown in FIG. 2, the filler material is held in position by a filler material retaining form 34 until cured. A section of the filler material retaining form 34 is shown in FIG. 2 in a hat-shaped form with a top surface 36 and a side surface 38 and subjacent lateral surface 40. This filler material retaining form 34 is shown along a portion of the foundation in FIG. 1. The two sides of the filler material form 34 are mirror images and therefore only one side is described. Beneath the subjacent lateral surface 40 is a strip of sealing material 42. The sealing material 42 is preferably formed of liquid-proof tape or sealant or the like. The sealing material 42 acts to prevent leakage of the filler material 32 from below the form 34.

The filler material 32 is preferably of a twopart (part A, part B) epoxy-resin system, where a base resin (part A) is metered and mixed with a catalyst/hardener (part B). The hardener acts to harden the liquid epoxy material in order to achieve a final stable, solid state. The epoxy must remain liquid, i.e., in a viscous state, for a suitable period of time in order that the filler material will flow and seek its own level. By allowing the filler material to seek its own level, the filler material will form a level foundation surface after it hardens. An epoxy-resin known commercially as F.E. 50/50 has proven to meet the necessary prerequisites. This epoxy has a relative viscosity of 12,750 Cp(mPa.s) and the resin has a relative viscosity of 4,250 Cp(mPa.s). Collectively, the epoxy-resin has a relative viscosity of approximately 6,500 Cp(mPa.s) which provides the necessary flow characteristics for the present invention.

The filler material 32 also preferably has an appropriate pot-life and set-up time. Pot-life is the amount of time elapsed from the time of the combination of the two parts of the epoxy-resin as liquid until the time when the combination becomes solid. Set-up time is the amount of time necessary for the epoxy-resin system to become fully stable. The F.E. 50/50 has an average pot life of three to six minutes and a set-up time to a full cure of 24 hours at 77 degrees Farenheit.

An additional preferable characteristic of the filler material is the ability of the hardened epoxy-resin layer to withstand weight or pressure. In its fully cured state, the F.E. 50/50 is able to withstand a maximum of 1275 pounds per square inch of pressure. The F.E. 50/50 material is temperature resistant through temperatures ranging from −20 degrees Farenheit to 200 degrees Farenheit. After curing, F.E. 50/50 will not absorb water and poses no extraordinary threat as far as toxicity or flammability.

The filler material 32 is held in the filler material retaining form 34 until the material has set. The retaining form 34 is preferably made of resilient material, such as construction paper, although nonresilient material will also work satisfactorily. It is understood that the invention is not limited to resilient material. Once the filler material has hardened, the paper form may be torn away from the filler material. The inside surface 44 of the paper is preferably poly-coated in order to provide the necessary strength and heat resistance encountered by the high temperatures of the catalyst-curing epoxy-resin. Additionally, poly-coating adds the necessary liquid-proof quality to the retaining form.

The retaining form 34, in a preferred embodiment, will resemble a top-hat in appearance, as shown in FIG. 2. The top surface 36 is approximately 3½ inches wide and the sidewall 38 is approximately 3 inches high. The top surface 36 is therefore substantially parallel to the top surface 18 of the concrete foundation, subject to the deviation of the top surface of the concrete foundation from a level surface. The subjacent lateral surface 40 is approximately ½ inch wide. It is expected that the paper will be delivered to the construction site in 2,000 lineal foot rolls for ease of handling. Perforations 46 may be placed in the top. Each perforation is approximately 2½ inches wide and 3 inches long. The perforations allow access to the foundation for pouring the filler material. The perforations also provide a venting function which allows venting of the heat that develops from the catalytic reaction. The retaining form 34 is placed in various sections along the foundation wall The ends of the sections of retaining form are sealed together with tape, or the like, prior to addition of the filler material. While the retaining form is shown in a hat-shaped configuration, it is to be understood that the form may be of other shapes, such as semi-circular or oval, and still be within the scope of the invention.

Figure 4:
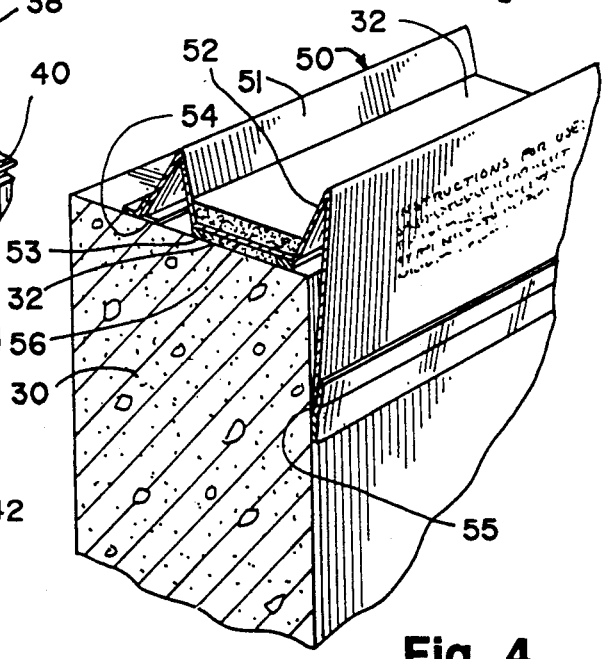
FIG. 4 is a perspective section view of an alternate embodiment of the retaining form of this invention with filler material therein.

An alternative embodiment of the retaining form is shown in FIG. 4. In that embodiment, the retaining form 50, which includes side surfaces 51, 52, is placed along the length of the foundation 30. The form 50 is sealed along the length by sealing material such as liquid-proof tape 53. The form 50 is sealed against the top and side of the foundation by secondary seals 54, 55. These secondary seals 54, 55 insure the integrity of the form 50 against the foundation during use. A series of perforations (not shown) are provided along the top surface 56 of the form 50. The filler material is added along the top of the form. The filler material seeps through the perforations and flows along the top surface of the foundation. After the filler material has hardened, the form may be stripped away from the material. The portion of the form across the top surface of the foundation is sandwiched within the hardened filler material and is not removed after the material has hardened. The side surfaces 51, 52 are disposed at an angle to top surface 56. This provides an area for holding the filler material 34 until the material has hardened.

Figure 5:
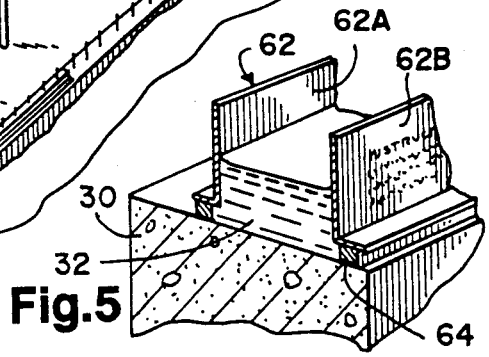
FIG. 5 is a perspective section view of an alternate embodiment of the retaining form of this invention with filler material therein.

Another alternative embodiment of the retaining form is shown in FIG. 5. In that embodiment, the retaining form 62 is constructed of two separate parts 62A, 62B. The form is sealed at the point of contact with the foundation 30 by liquid-proof tape 64. Instead of a perforation, the form 62 is simply open at the top for filler material access.

In operation, the system provides a method for applying a layer of filler material to an existing foundation in order to provide a substantially level foundation surface. The method requires determining the amount of deviation of the top surface of a foundation wall from a level surface. This can be done by determining the distance from the highest point to the lowest point at various points along the foundation surface. Once this deviation is determined, the amount of filler material sufficient to minimally exceed the volume formed by the deviation along the foundation wall must be calculated. This is a simple calculation based on the density of the filler material and the amount of volume necessary to be filled and then adding an amount in order to assure filling the volume of the deviation. Determination of the amount of material necessary to minimally exceed the volume of the deviation assures filling of the deviation while not wasting filler material. The filler material will seek its own level within the form and thus determination of an exact amount of material is not necessary.

In order to add the layer of filler material, the retaining form is positioned along the top surface of the wall. The form may be cut from the sheets and sealed at each end in order to provide a cavity for filling. The form should also be secured to the foundation surface at the subjacent surfaces by sealing material. The form may also be secured by secondary seals in order to insure the integrity of the form.

The filler material is added to the foundation by pouring the previously-determined amount of filler material into the retaining form. Once inside the retaining form along the section of the foundation wall, or the entire wall depending on the chosen area of work, the filler material will seek its own level. Thus, as shown in FIG. 3, the layer of filler material 32 will supplement the layer of existing concrete 30 and provide a level top surface 60 of the filler material. The filler material is then left to harden. Once the filler material hardens, the top surface 60 of the filler material is now a level surface above the foundation.

Thus, a method for providing a substantially level foundation has been provided which meets the aforestated objects. The method provides the application of a layer of filler material to an existing concrete foundation.

While the preferred embodiments of the invention are illustrated, it will be understood, of course, that the invention is not limited to these embodiments. Those skilled in the art to which the invention pertains may make modifications and other embodiments employing the principles of this invention, particularly upon considering the foregoing teachings.

What is claimed is:

1. A method of applying a layer of filler material to an existing concrete foundation to provide a substantially level foundation surface, comprising the steps of:

selecting a settable filler material having a slow enough setting time and a low enough viscosity to flow and assume a level condition over a substantial portion of a wall without the need of screeding, generally determining the amount of deviation of the top surface of a foundation wall from a level surface, determining the amount of said filler material sufficient to exceed the volume formed by said deviation along said foundation wall, positioning a means to retain said filler material along said top surface of said foundation wall, securing said filler material retaining means to said foundation such that it provides for a sufficient vertical interval above said foundation for said filler material to seek its own horizontal level within said retaining means, pouring said determined amount of filler material into said filler retaining means, allowing said filler material to seek its own level within said retaining means, and allowing said filler material to harden.

2. The method of claim 1 wherein said filler material retaining means comprises a sheet of resilient material formed with a plurality of surfaces, said surfaces including a top surface and a side surface.

3. The method of claim 2 wherein said sheet includes said top surface disposed substantially parallel to said foundation wall top surface.

4. The method of claim 2 wherein said securing step includes securing the lateral subjacent edges of said sheet against the foundation with sealant.

5. The method of claim 2 wherein said pouring step includes pouring of said filler material occurring through a perforation in the top surface of said retaining means.

6. The method of claim 1 wherein said filler material further comprises a liquid epoxy-resin.

7. A method of applying a predetermined layer of filler material onto an existing foundation to provide a substantially level foundation surface, comprising the steps of:

selecting a predetermined amount of settable filler material having a slow enough setting time and a low enough viscosity to flow and assume a level condition over a substantial portion of a wall without the need of screeding, positioning a means for retaining filler material in a substantially stationary position, along the surface of a foundation wall, securing said filler material retaining means to said foundation such that it provides for a sufficient vertical interval above said foundation for said filler material to seek its own horizontal level within said retaining means, pouring said predetermined amount of filler material into said filler material retaining means, allowing said filler material to seek its own level within said retaining means, and allowing said filler material to harden.

8. A method of applying a layer of highly non-viscous material onto an existing foundation to provide a supplementary foundation surface when hardened, comprising the steps of:

selecting a highly non-viscous settable filler material having a slow enough setting time and a low enough viscosity to flow and assume a level condition over a substantial portion of a wall without the need of screeding, positioning a means for retaining highly non-viscous material along the surface of a foundation wall, securing said material retaining means to said foundation such that it provides for a sufficient vertical interval above said foundation or said filler material to seek its own horizontal level within said retaining means, pouring said highly non-viscous material into said material retaining means, allowing said filler material to seek its own level within said retaining means, and allowing said material to harden.

9. A substantially level foundation wall system comprising:

an existing foundation wall, a layer of hardened epoxy-resin material, said layer formed at the top surface of said foundation wall, and said layer formation being formed by the steps comprising:

selecting a settable epoxy-resin material having a slow enough setting time and a low enough viscosity to flow and assume a level condition over a substantial portion of a wall without the need of screeding, positioning a means for retaining liquid epoxy-resin material along said top surface of said foundation wall such that a sufficient interval is provided above said foundation for said filler material to seek its own horizontal level within said retaining means, securing said material retaining means to said foundation, pouring said selected liquid epoxy-resin material into said material retaining means, allowing said epoxy-resin material to seek its own level within said retaining means, and allowing said epoxy-resin material to harden, whereby the hardened epoxy-resin material provides a level surface for the foundation wall system.

* * * * *